United States Patent [19]

Weidenhagen et al.

[11] 4,196,669

[45] Apr. 8, 1980

[54] DISPERSION WARHEAD

[75] Inventors: Dieter Weidenhagen, Neubiberg; Hubert Vockensperger, Feldkirchen; Dieter Kampa, Oberbiberg; Klaus Zimmerman, Münich, all of Fed. Rep. of Germany

[73] Assignee: Messerschmitt-Bolkow-Blohm GmbH, Münich, Fed. Rep. of Germany

[21] Appl. No.: 882,768

[22] Filed: Mar. 2, 1978

[30] Foreign Application Priority Data

Mar. 8, 1977 [DE] Fed. Rep. of Germany ..... 2709969

[51] Int. Cl.[2] ..... F42B 13/50

[52] U.S. Cl. ..... 102/69; 102/49.7; 102/7.2

[58] Field of Search ..... 102/7.2, 34.4, 35.6, 102/37.6, 49.3, 49.4, 49.5, 49.7, 56 R, 69; 89/1.815

[56] References Cited

U.S. PATENT DOCUMENTS

| | | | |
|---|---|---|---|
| 2,376,227 | 5/1945 | Brown | 102/7.2 |
| 2,972,950 | 2/1961 | Welanetz | 102/49.3 |
| 2,995,319 | 8/1961 | Kershner | 102/49.4 |
| 3,295,444 | 1/1967 | Cushing | 102/7.2 |
| 3,439,613 | 4/1969 | Thomanek | 102/49.3 |
| 3,726,223 | 4/1973 | Moe | 102/56 |
| 3,916,794 | 11/1975 | Mayer | 102/69 |
| 4,112,848 | 9/1978 | Lallinger | 102/69 |

FOREIGN PATENT DOCUMENTS

| | | | |
|---|---|---|---|
| 1346448 | 11/1963 | France | 102/7.2 |

*Primary Examiner*—Verlin R. Pendegrass

*Attorney, Agent, or Firm*—Toren, McGeady and Stanger

[57] ABSTRACT

A plurality of individual containers holding ammunition bodies are arranged within a dispersion warhead. A reaction engine is provided for each container or each of a group of containers. The reaction engines are mounted on the exterior surfaces of the containers, preferably on the container bottom. A rocket engine fueled with a body of solid fuel can be used as the reaction engine. Ignition means are provided at each end of the body of fuel. A centrally positioned detonating channel extends between the ends of the body of solid fuel. A slot-shaped continuous gas channel extends through the body of solid fuel between its ends and also extends laterally outwardly from the detonating channel to the surface of the body.

7 Claims, 3 Drawing Figures

Fig.1
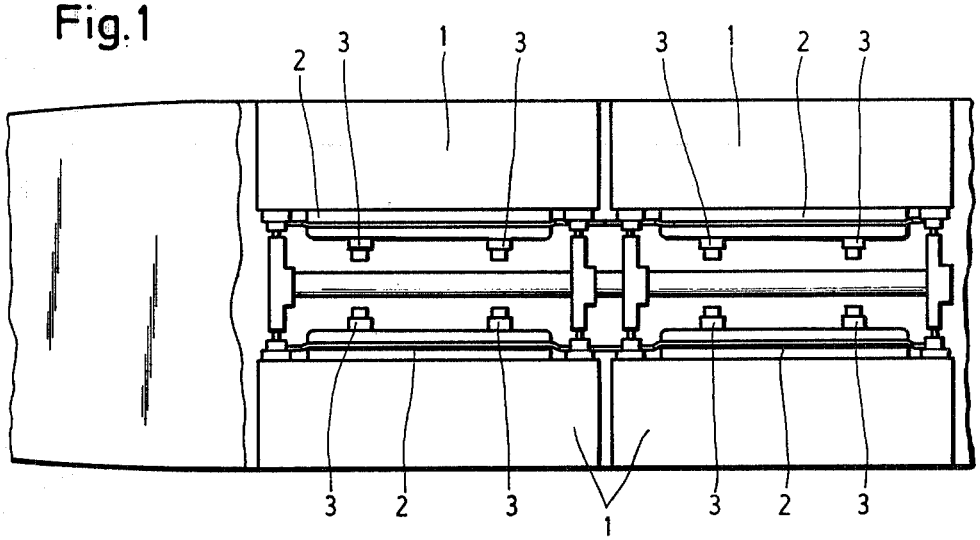
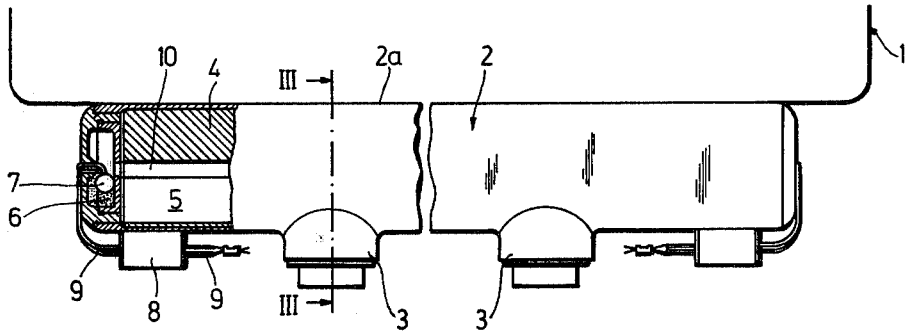
Fig.2
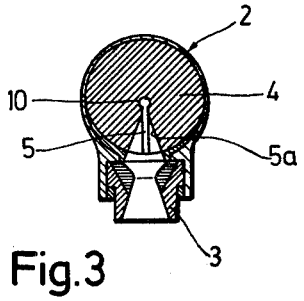
Fig.3

DISPERSION WARHEAD

SUMMARY OF THE INVENTION

The present invention is directed to a dispersion warhead and is more particularly concerned with a warhead in which a plurality of individual containers are positioned each holding ammunition bodies. The ammunition bodies are dispersed after the containers have been ejected from the warhead.

Dispersion ammunition is used for effectively attacking a large target area, that is, to cover a large area where the enemy is deployed with a plurality of ammunition bodies of various kinds or to cut off temporarily certain areas from attacking enemy units or for persistently harassing withdrawal movements of the enemy. The special advantage of dispersion ammunition involves the ability to cover large target areas which cannot be destroyed or would be difficult to destroy by a concentrated attack of fire power. By use of the dispersion ammunition sufficient accuracy can be attained to achieve the desired military objective. Since the effectiveness of a weapons system results from the probability of the ammunition striking the target and the military effect of the ammunition at the target, the effectiveness can be increased by improving the probability of striking the target even if the effect at the target is lowered. The increased probability of striking the target is more important in the overall effectiveness of the weapons system. Additionally, the effectiveness of such weaponry is heightened by arranging the dispersion ammunition in a plurality of militarily effective bodies. In the past individual dispersion ammunition containers have been ejected from a warhead by means of propellant charges or springs. When either of these means are used for absorbing the forces which occur on the warhead body and on the dispersion ammunition container, the body and container constructions must be of appropriate strength which results in a relatively heavy structural weight of the members. Therefore, the dispersion range in the target area is limited where the structural weight of the assembled warhead is too great when taking into consideration the range of the carrier vehicle, for instance a rocket or aircraft or where the dimensions of the carrier vehicle are too large. For strategical and practical reasons, however, it is important to provide a large range of action for the carrier vehicle and also to afford a maximum dispersion range in the target area.

It is the primary object of the present invention to achieve a maximum dimension for each of these ranges while, at the same time, reducing the overall structural weight of the dispersion warhead so that an optimum relationship is provided between the weight of the warhead and the payload at a maximum dispersion range. Therefore, in accordance with the present invention, an improved dispersion warhead is provided by assembling individual dispersion ammunition containers within the warhead casing with at least one reaction engine for one or a number of the containers.

Dispersion ammunition containers equipped with their own reaction engines guarantee a reduced structural weight for the warhead and the containers, since, compared to the use of explosive powder charges, the reaction engines operating at a significantly lower acceleration cause significantly less stress on the warhead casing and on the structure of the container. Moreover, a special military advantage is attained in that a significantly larger region can be covered by the dispersion ammunition, since the dispersion range depends only on the installed energy or the operating potential of the reaction engine which provides a less damaging effect on the structure of the ammunition containers than the suddenly acting explosive powder charges.

Depending on the deployment of the enemy and the individual areas to be attacked, various dispersion patterns are needed or the ammunition bodies must be concentrated in individual areas. In accordance with the present invention, these situations can be adequately handled by providing individual containers or groups of containers with reaction engines of different energy ratings. As a result, it is possible to provide a military coverage which can be adjusted to the individual situation. Such individual coverage programs can be set up while the warhead is still on the ground or, when in the air, by selecting individual containers to be dropped in a particular sequence.

Reaction engines particularly suited for use in such military situations are solid fuel rocket engines, since they are small in size, have a high power density, are simple in construction, and storage of such engines presents less of a problem.

When a large dispersion range is desired, ram jet engines can be used in accordance with the present invention which engines obtain their oxygen supply from the surrounding air by ram charging which results in lower weight and, the weight of the fuel being equal, in a larger radius of action.

In accordance with the present invention, the reaction engines may be installed in a simple manner on the outer surface of the containers, in particular on the container bottoms. In such an arrangement, it is advantageous to position the combustion chamber of the reaction engine with the solid fuel alongside the container bottom.

To limit the structural size of the warhead when the dispersion chambers are arranged radially next to one another in the peripheral direction, a plurality of discharge nozzles can be provided for each combustion chamber, since the total thrust power can be maintained while the use of several discharge nozzles reduce the length of the individual nozzle as compared to one larger nozzle.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the Drawing:

FIG. 1 illustrates a dispersion warhead, partly in longitudinal section, embodying the present invention;

FIG. 2 shows a solid fuel rocket engine, partly in section, mounted on a dispersion ammunition container; and FIG. 3 is a sectional view taken along the line III—III in FIG. 2.

DETAILED DESCRIPTION OF THE INVENTION

In FIG. 1 a plurality of dispersion ammunition containers 1 are shown within a warhead casing. Individual groups of containers are provided one aligned behind the other in the axial direction of the warhead casing while in each group the containers are disposed in an annular pattern. As shown in FIG. 1, each dispersion ammunition container has a reaction engine 2. Each reaction engine has a longitudinally extending combustion chamber 2*a* with at least two discharge nozzles 3 extending outwardly from the combustion chamber. The reaction engines 2 are mounted on the bottoms of the containers 1.

As illustrated in FIGS. 2 and 3, the reaction engines are rocket engines 2 containing a body of solid fuel 4 in which a continuous slot-shaped gas channel 5 is formed radially inwardly from the outer surface of the body to approximately its center. Individual discharge nozzles 3 are connected to the gas channel 5 in a manner which takes into consideration the flow conditions. At the location of each discharge nozzle 3, the gas channel 5 has a funnel-shaped enlargement 5*a* for creating more favorable inflow conditions. The body 4 of solid fuel extends axially between two end surfaces and an igniting charge 6 is provided at each end surface. Each igniting charge 6 is fired by a primer capsule 7. Firing circuits 9 are connected to the primer capsules 7 and extend through electrical disturbance filters 8. The flames generated by the igniting charge 6 pass through a centrally arranged detonating channel 10 through the body 4 communicating with the inner end of the gas channel 5 for igniting the solid fuel along the length of the detonating channel. While specific embodiments of the invention have been shown and described in detail to illustrate the application of the inventive principles, it will be understood that the invention may be embodied otherwise without departing from such principles.

What is claimed is:

1. Dispersion warhead comprising a warhead casing forming a chamber, a plurality of individual containers disposed within said warhead chamber each arranged to hold a plurality of ammunition bodies to be dispersed after said containers are ejected from the warhead chamber, wherein the improvement comprises that a reaction engine is provided for at least a group of each of said containers, said reaction engine is a rocket engine fueled by a body of solid fuel, said body of solid fuel extends axially between a front end and rear end of the body, a continuous gas channel extending axially through said body of solid fuel between the front and rear ends thereof, a plurality of discharge nozzles mounted on said reaction engine and each being connected to said gas channel at spaced positions therealong, and means located at the front and rear ends of said body of solid fuel for igniting the fuel.

2. Dispersion warhead, as set forth in claim 1, wherein each said container has one said reaction engine mounted thereon.

3. Dispersion warhead, as set forth in claim 2, wherein said reaction engines of separate said containers have different power outputs.

4. Dispersion warhead, as set forth in claim 2, wherein said reaction engines are mounted on the outer surface of said containers.

5. Dispersion warhead, as set forth in claim 4, wherein said reaction engines are mounted on the bottom of said containers.

6. Dispersion warhead, as set forth in claim 1, wherein each said rocket engine includes a combustion chamber containing said body of solid fuel and said combustion chamber positioned alongside the bottom of said container on which said engine is mounted.

7. Dispersion warhead, as set forth in claim 1, wherein said continuous gas channel comprises a slot-like passageway extending into said body of solid fuel from the axial extending surface thereof and extending transversely of the axial direction to approximately the center of said body of solid fuel, a centrally positioned continuous detonating channel extending axially through said body of solid fuel between the front and rear ends thereof and opening to said gas channel, a funnel-shaped enlargemnt of said slot-like passageway located at each of said discharge nozzles, said means for igniting said body of solid fuel comprising an igniting charge positioned at each of the front and rear ends of said body of solid fuel, a primer charge positioned against each said igniting charge, a firing circuit connected to said primer charge, and an electrical disturbance filter positioned in said firing circuit.

* * * * *